US005307647A

United States Patent [19]

McClure

[11] Patent Number: 5,307,647

[45] Date of Patent: May 3, 1994

[54] FOOD SERVING REFRIGERANT DEVICE

[76] Inventor: Ralph K. McClure, 6589 Leffingwell Rd., Canfield, Ohio 44406

[21] Appl. No.: 865,955

[22] Filed: Apr. 9, 1992

[51] Int. Cl.[5] ..... F25D 3/08

[52] U.S. Cl. ..... 62/371; 62/457.2; 62/457.6; 62/529

[58] Field of Search ..... 62/457.1, 457.2, 457.6, 62/529, 530, 371, 463, 438, 430; 220/380, 287

[56] References Cited

U.S. PATENT DOCUMENTS

| | | | |
|---|---|---|---|
| 19,432 | 2/1858 | McEvoy . | |
| 24,636 | 7/1859 | Smith | 62/463 |
| 284,531 | 9/1883 | Berry . | |
| 2,542,173 | 2/1951 | Wolf | 62/438 |
| 2,810,276 | 10/1957 | Murray . | |
| 3,130,288 | 4/1964 | Monaco et al. . | |
| 3,255,607 | 6/1966 | Bair et al. . | |
| 3,710,589 | 1/1973 | Brown et al. . | |
| 3,981,401 | 9/1976 | Blanchard | 220/380 |
| 4,019,340 | 4/1977 | Conklin . | |
| 4,024,731 | 5/1977 | Branscum . | |
| 4,304,106 | 12/1981 | Donnelly . | |
| 4,375,758 | 3/1983 | Simmons . | |

*Primary Examiner*—John M. Sollecito

*Attorney, Agent, or Firm*—Watts, Hoffmann, Fisher & Heinke, Co.

[57] ABSTRACT

A conveniently stackable, storable, transportable and displayable food service device utilizing temperature maintaining refrigerant units to provide a relatively convenient and inexpensive method of refrigerating, transporting and serving food is provided. The temperature maintaining refrigerant units are disposed within a refrigerant cavity configured in a base of the device in interfitted puzzle-like fashion. The refrigerant units are interchangeable and may be easily stored and replaced after their temperature maintaining capacity has been exhausted. A food tray is designed to removably interfit with the base of the device such that the food surface of the tray is supported in spaced relationship above the refrigerant units when the food tray and base are in nested relationship. A cover is provided to fit in supporting relationship with the food tray. The cover includes a recess portion to nestingly accept the exterior of the base to elevate the base and food tray for display and service purposes. The cover also receives the base of another like container so that a stack of refrigerated devices may be easily transported and/or stored. The cover also includes a channel to prevent condensation from dripping onto and spoiling the food servings supported on the tray.

15 Claims, 5 Drawing Sheets

FOOD SERVING REFRIGERANT DEVICE

FIELD OF THE INVENTION

This invention relates to an improved food service device. More specifically, this invention relates to a conveniently storable and nestable food service device having removable recyclable refrigerant media for use in the transportation and service of prepared foods.

BACKGROUND ART

Food service operations typically employ a number of food service devices to provide for the service of food at weddings or parties, and in institutional environments such as hospitals. In many instances, the food servings are prepared in a kitchen or elsewhere, and transported to a dining location. The servings are stored upon food service trays which can be readily heated or cooled as dictated by the dish to be served.

In food service operations, it is necessary to refrigerate many of the food items which are to be served. Ice has been placed in and around the food servings or the containers holding the food servings to be chilled. Portable ice tables which would include food trays, handles, ice recess storage compartments, and drainage ports to drain off water resulting from the melted ice have been proposed. However, the need to continuously replace the melted ice and drain the accumulated water would be cumbersome and non-aesthetic. Such tables may also include covers which would promote the refrigeration of the food servings placed upon the food trays.

Another proposed apparatus for displaying refrigerated food servings comprises a nesting bowl assembly. The proposed assembly would include a first and second bowl, the first bowl sized to nest within the second bowl. A volume of water or other such material would be deposited in the second bowl. The first bowl would then be nested within the second bowl to displace the water about the first bowl exterior surface. The bowls could then be placed in a cooler to freeze the water. Once the water is frozen, the food servings to be chilled would be placed within the first bowl. The servings would then displayed as required. As the ice melted, it would recede into the second bowl thereby reducing the total refrigerated surface area of the first bowl so that once the refrigerating capacity of the ice was exhausted, it would need to be replaced. Alternatively, the food servings could be transferred to a similar device where the water refrigerant was frozen. The inconvenience associated with renewing the ice and/or the substitution of a number of similar bowl assemblies required to refrigerate and display food servings over an extended period of time would be costly and cumbersome.

Another proposed serving device comprises a portable open-topped receptacle having a double bottom and a hinged cover. The double bottom would define a space to accommodate a temperature-maintaining fluid such as a bath of water. The device would include two concave shelves rigidly interconnected along their peripheries. The shelves' bodies would be separated to define the space which may accommodate the bath of water. The proposed food receptacle would constitute a pan with a peripheral ledge having one or more trays, dishes or other similar containers suspended from the ledge. The temperature maintaining fluid would be disposed within the space between the shelves about the suspended pan to cool the food. However, once the refrigerating capacity of the water is exhausted, the food servings would have to be transferred to additional devices having a refrigerated water bath. water bath.

Another proposed tray of rectangular configuration is said to be adapted for patient feeding in institutional settings. The tray would include a body having an upper and lower plate which define a recess portion surrounded by a chamber. The chamber purportedly would contain a heat-generating mixture which is repeatedly changeable from a solid to liquid state or from a liquid to crystalline state to produce heat. The proposed chamber would be very shallow and intended to have a relatively uniform depth. The upper and lower plates would be hermetically sealed to prevent leakage of the mixture from the chamber. Once assembled, the mixture purportedly radiates heat. When used in a hospital, the tray would be made ready for use by immersing it in a hot water bath having a temperature between 200°-212° F. for at least 30 minutes. During immersion, the mixture would absorb substantial amounts of heat. Thereafter, food would be stored upon the tray. As the tray cools, the mixture would emit heat during a transition temperature phase (approximately 193°). Once the temperature maintaining ability of the tray would be exhausted, the food would have to be food transferred to another fresh tray to maintain its temperature, a costly and time-consuming procedure.

Another proposed thermal enclosure purportedly comprises a container having a removable cover to provide access to an interior cavity. The cover would include a frame in the inner and outer ends, and a passage extending through the frame. The frame also purportedly would include a peripheral wall and a ledge which would extend radially inwardly from the wall. An inner end wall would be positioned in the passage, supported on the ledge. An outer end wall would be affixed to the peripheral wall. Material for adding or removing heat would be provided in the passage between the end walls.

None of these proposed devices disclose an apparatus for conveniently storing, transporting, displaying and serving refrigerated foods for extended periods of time wherein the trays may be nested and a temperature maintaining refrigerant media conveniently replaced with additional like units which are cleanly and easily disposed within the device. Moreover, none of these devices disclose an apparatus which is cleanly and easily assembled for use or disassembled so that each component of the device may be stackably stored with other like components separately from the remainder of the food service device. Moreover, replenishing the temperature maintaining refrigerant media in many cases would require transfer of the food from a used storage device to a fresh storage device. Lastly, no method or mechanism is disclosed whereby the temperature maintaining refrigerant media may be interfitted in a puzzle-like fashion within a particular food service device to maximize the refrigerated surface area of the device while minimizing the space required for storing the temperature maintaining media apart from the device.

SUMMARY OF THE INVENTION

The present invention provides a stackable food service device which utilizes temperature maintaining refrigerant units to provide a relatively convenient and inexpensive method of refrigerating food servings.

Temperature maintaining refrigerant units are disposed in interfitted puzzle-like fashion within a refrigerant cavity configured in the base of the device. The refrigerant units are generally interchangeable and may be easily stored and replaced after their refrigerant capacity has been exhausted.

A food tray is designed to removably interfit with the base such that the food surface of the tray is supported in spaced relationship above the refrigerant units when the food tray and base are in interfitted relationship. A cover is provided to fit in supported relationship over the food tray. The cover includes a recess portion which is configured to nestingly accept the exterior of the base so that the cover may act to elevate the base and food tray for display and service purposes.

The cover recess also acts to receive the base of another like device so that a stack of refrigerated devices may be easily transported and/or stored. Additionally, the cover recess and side walls define a channel to trap condensation thereby inhibiting the collection of condensation over the food at a location where it will drip onto the food. Lastly, the components are designed to facilitate stackable storage with other like components when not in use.

The object of the present invention is to provide a novel and improved apparatus for conveniently storing, transporting, displaying and serving refrigerated foods and a method of use. Another object is to provide a novel removable temperature maintaining refrigerant media which is conveniently placed within the device in interfitted puzzle-like relationship. The temperature maintaining refrigerant media may be conveniently and economically replaced as needed.

DETAILED DESCRIPTION OF THE DEVICES EMBODYING THE INVENTION

Figure 1:
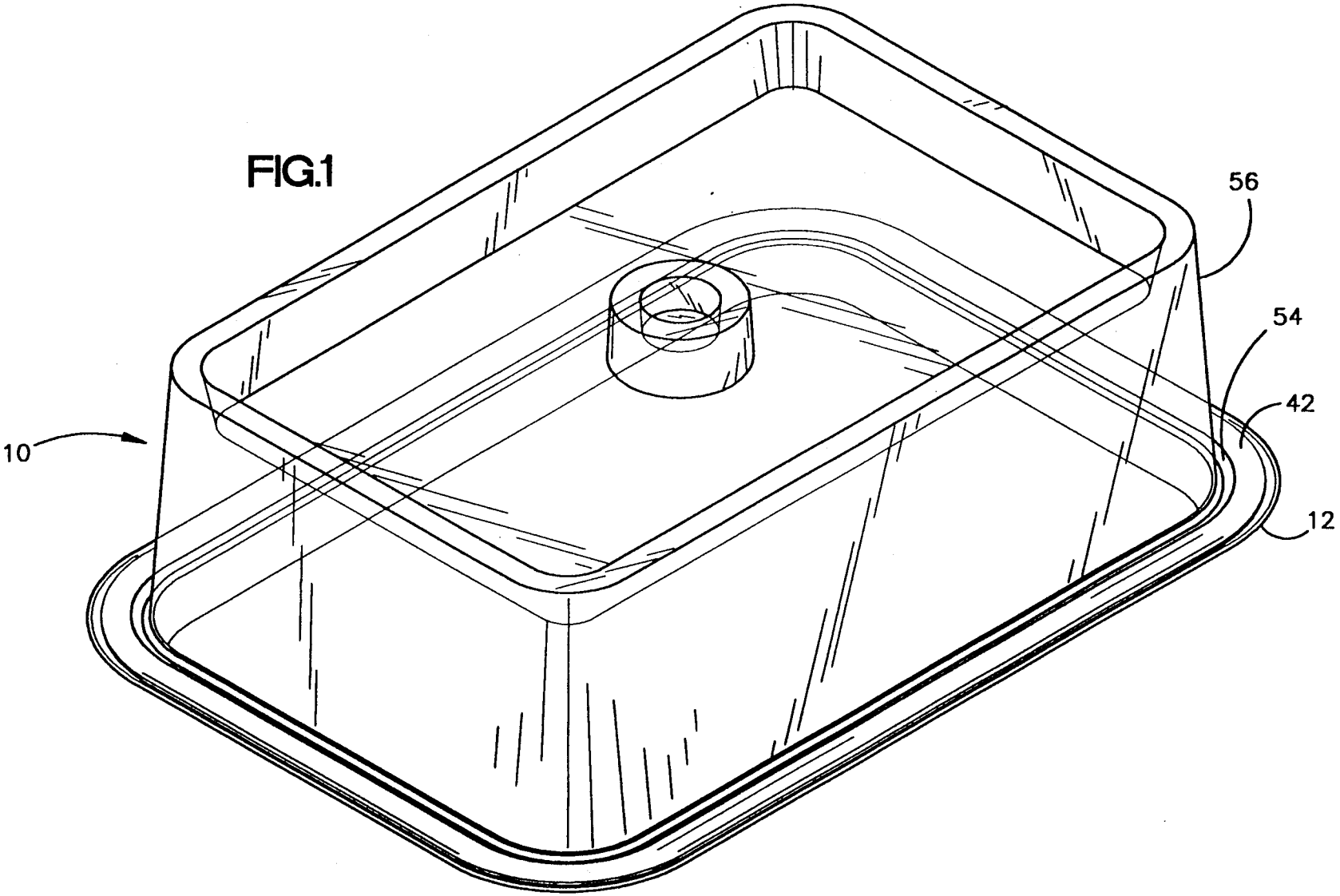
FIG. 1 is a perspective view of the food service device embodying the invention.
Figure 2:
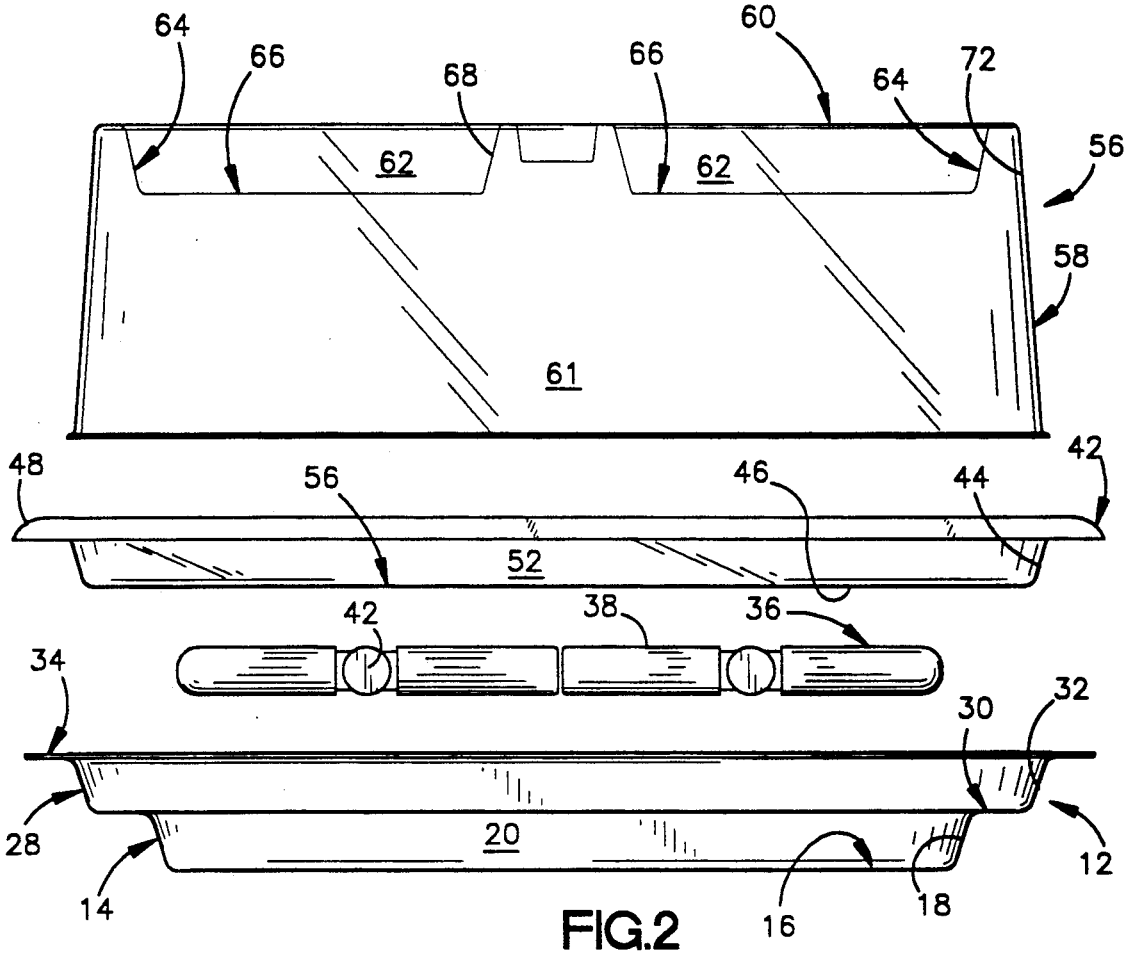
FIG. 2 is an exploded view of the components of the device of FIG. 1.
Figure 5:
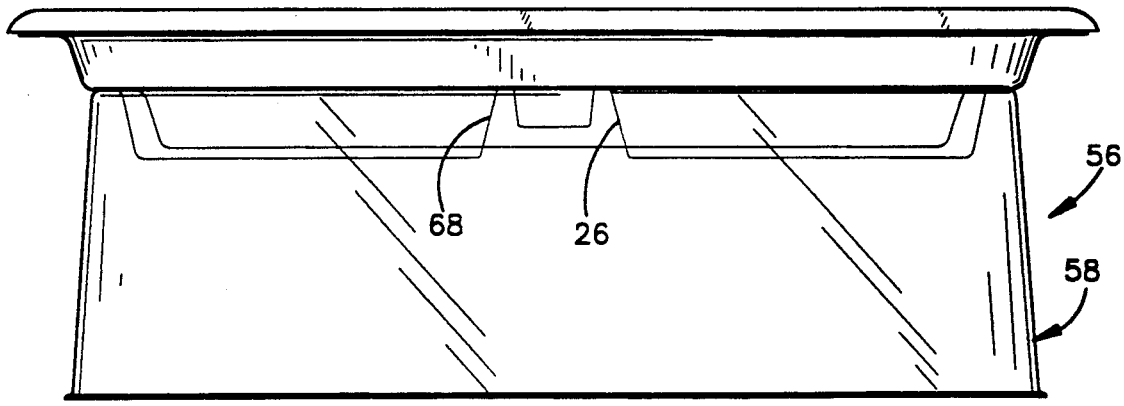
FIG. 5 is a side elevational view of the device of FIG. 2, wherein the cover is utilized to elevate the base and food tray of the device.
Figure 3:
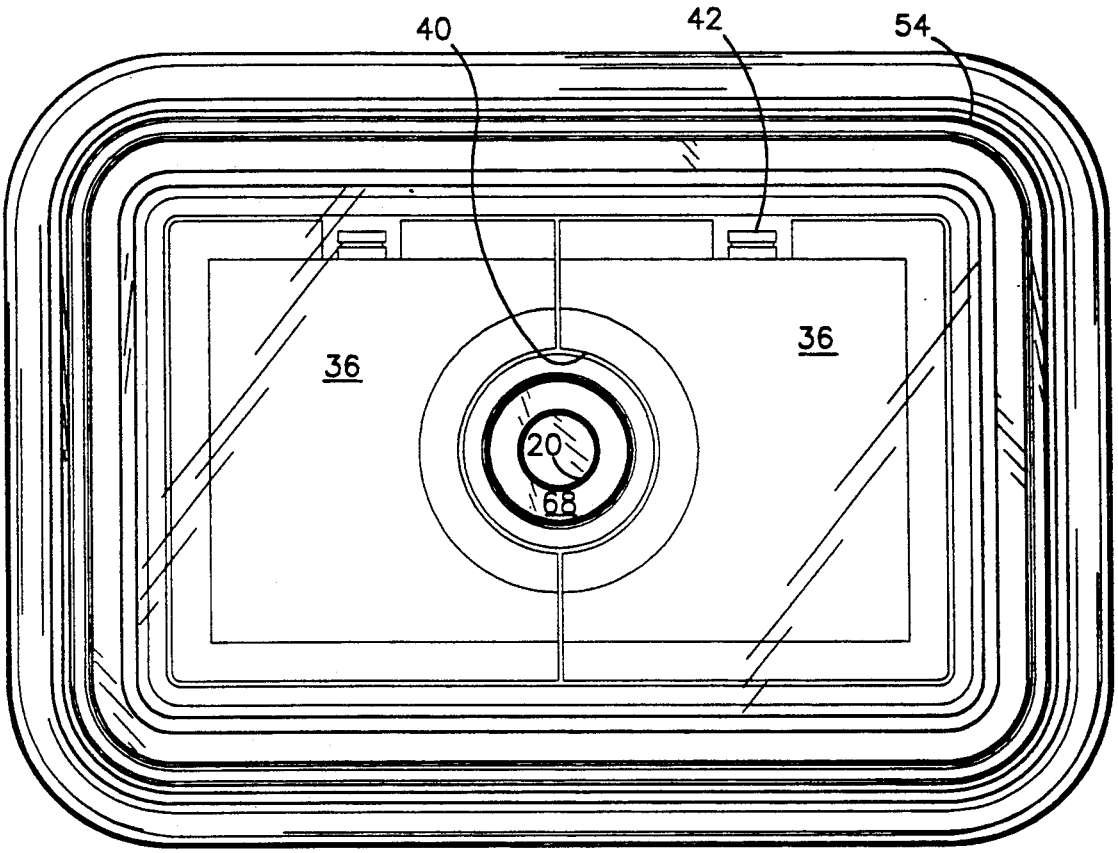
FIG. 3 is a top plan view of the device illustrated in FIGS. 1 and 2.
Figure 4:
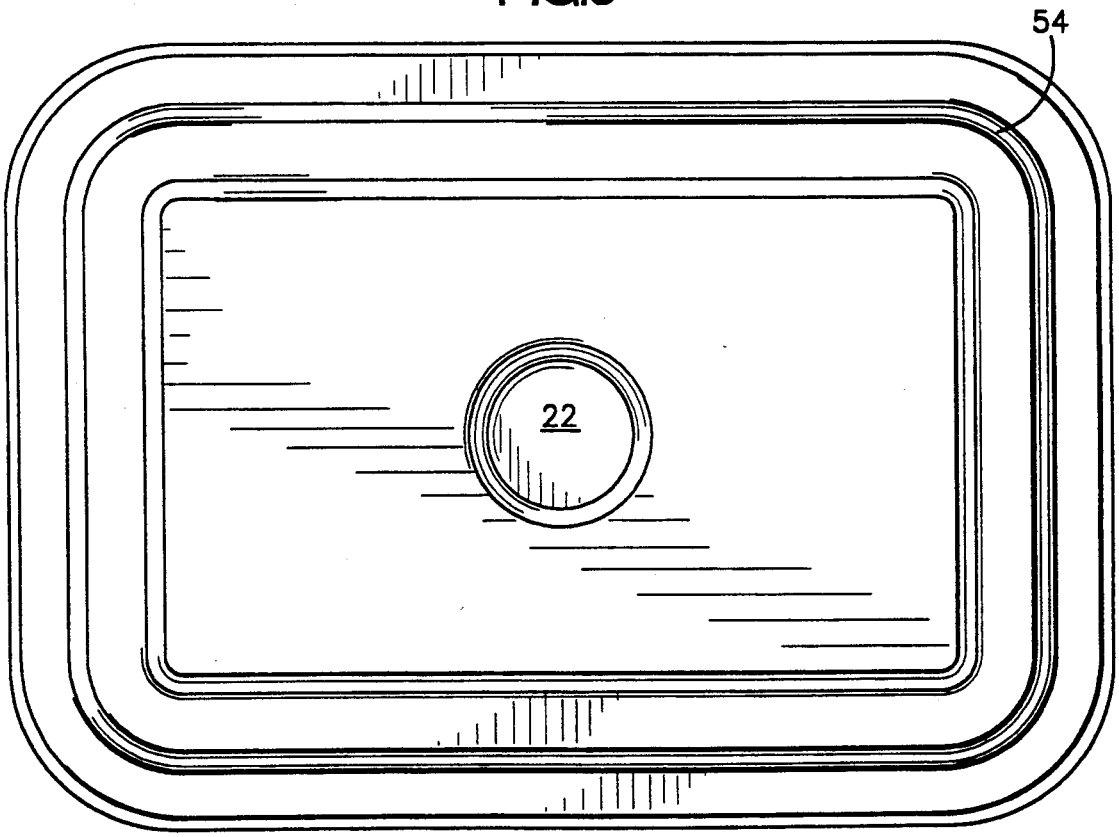
FIG. 4 is a top plan view of the interfitted base and food tray device of FIG. 2.

Referring now to the drawings, the food service device 10 of the present invention is disclosed. The device will typically be manufactured of polypropylene or other similar resin-based materials through standard injection molded processes. Such materials are ideal since they are resistant to chemical attacks which result from sterilization or other processes to which the device 10 may be exposed.

The food service device 10 includes a base portion 12. The base includes a base lower surface 16 integrally secured to base side walls 18. The base lower surface 16 and the side walls 18 define a refrigerant cavity 20. The refrigerant cavity 20 includes a centrally located refrigerant positioning portion 22 which extends upwardly from the base lower surface 16. The positioning portion 22 protrudes a distance slightly less than the height of the base side walls 18. The refrigerant positioning portion 22 also defines an aperture 24 in the exterior base surface 26.

The base 12 also includes a tray support surface 30 and a tray support portion 32. The tray support surface 30 is integrally and perimetrally secured to the uppermost portion of the base side walls 18. The tray support portion 32 is perimetrally secured to the tray support surface 30 and extends from said support surface 30 in a substantially perpendicular direction. The base 12 also includes a mantle 34 which is integrally secured to the upper perimeter of the tray support portion 32 opposite the tray support surface 30.

A plurality of temperature maintaining refrigerant units 36 include a solid external surface 38 which defines an internal volume (not shown) and a complemental aperture 40. The refrigerant unit also includes a cap arrangement 42 whereby a temperature maintaining refrigerant media may be introduced into the volume of the refrigerant unit 36. In use, cooled refrigerant units 36 are disposed within the refrigerant cavity 20 so that the refrigerant positioning portion 22 of the cavity 20 interacts with the complemental aperture 40 of the refrigerant units 36 in puzzle-like relationship. When not in use, the units 36 may be discretely stored in a freezer or other like device apart from the remainder of the device 10.

A food tray 42 is comprised of side walls 44, a tray bottom 46 and a perimetral portion 48. The tray bottom 46 defines a food support surface 50 which, together with the side walls 44 further define a central recess portion 52. The perimetral portion 48 also defines a cover support surface 54 which extends adjacent the perimeter of the tray side walls 44. When not in use, the tray 42 may also be conveniently stored and transported in a stacked relationship with other like trays.

A cover 56 includes side walls 58 and a roof 60. The roof 60 and side walls 58 define a recess section 62 having recessed walls 64 and a recess section base 66. A centrally located knob-like handle 68 extends upwardly from the recess section base 66 and includes a gripping portion 70. The roof 60 and side walls 58 in combination with the recess section all 64, define a condensation channel 72 which impedes condensation from dripping onto the food supported by the food tray 42. The cover 56, together with the side walls 58 and the roof 60, define a food storage volume 61 which serves to protect the food items which are to be refrigerated upon the tray 42 when in use. The roof recess section 62 is designed to be of dimension slightly greater than the exterior surface of the refrigerant cavity 20 located in base 12 so that a number of like assembled devices may be stored or transported in stacked relationship. When stacked, the handle 68 fits within the base aperture 24 in aligning relationship. Alternatively, the cover 56 may also be stacked with other like covers for storage and/or transport when not in use.

In use, the device may be conveniently assembled from individual stacks of like components in a production line manner. Initially, a number of refrigerant units 36 are placed within the refrigerant cavity 20. The refrigerant positioning portion 22 aligns the units 36 by coacting with the complemental aperture 40 defined by the solid external surface 38. The refrigerant units 36, when so placed remain in a stable interfitted position within the cavity 20 until removed. Thereafter, a food tray 42 is disposed in nesting relationship with the base 12 so that the bottom of tray 42 is perimetrally supported by the base tray support surface 30. Additionally, the refrigerant positioning portion 22 also centrally supports the food tray 42 should the tray 42 sag under the weight of the food disposed upon the food support surface 50. The food tray side walls 44 are encased by the base support portion 32. The food tray perimetral portion 48 overlaps the mantle 34 in fitted relationship. When nested, the tray central recess portion 52 is substantially prevented from moving in transverse or lateral directions by the mantle 34 and side walls 32. The food item to be refrigerated is supported by the food tray support surface 50. The cover 56 is then positioned adjacent the food tray 42 such that the cover side walls 58 coact in supporting relationship with the cover support surface 54. The assembled device may then be displayed, transported, or stored in a singular or stacked relationship as required.

Figure 6:
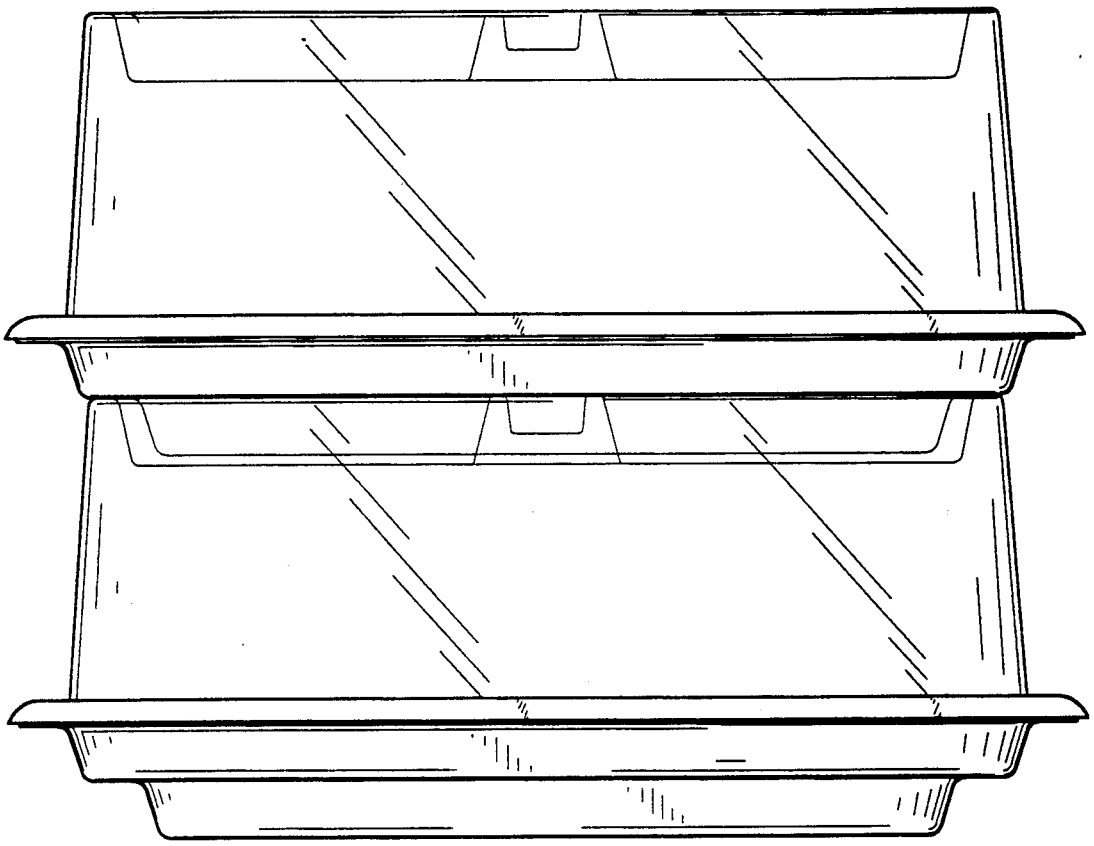
FIG. 6 is a perspective view of a plurality of the food service devices of FIG. 1 in stacked relationship.

As shown in FIG. 6, another refrigerant device 10 may be placed atop the cover 56 so that the refrigerant cavity 20 nests in stacking relationship with the cover recess section 62. When nested, the cover handle 62 coacts with the aperture 24 of a like tray to promote a stabilizing arrangement. A number of refrigerant devices 10 may be stacked in this manner to facilitate shipment. The stacking of a number of refrigerant devices 10 also facilitates the storage and removal of prepared foods in commercial kitchens and other like places.

Additionally, when the refrigerated food is ready to be served, a stack of food service devices 10 may be transported to a dining area and individually displayed. The cover 56 may be removed to provide access to the food stored upon tray 42. The cover 56 may also be placed in nesting relationship with the exterior of the refrigerant cavity 20 to elevate the base 12 and food tray 44 for display and service purposes. When used in this manner, the handle 68 coacts with aperture 24 to align and stabilize the device 10. After a period of time, the temperature maintaining capacity of the refrigerant units 36 may be exhausted. The refrigerant units 36 may then be easily replaced by unnesting the food tray 42 from the base 12 and removing the units 36. A number of like, fresh, replacement temperature maintaining refrigerant units can then be disposed in fitted, puzzle-like relationship within the refrigerant cavity 20. The food tray 42 is then redisposed in nesting relationship with the base 12.

Figure 7:
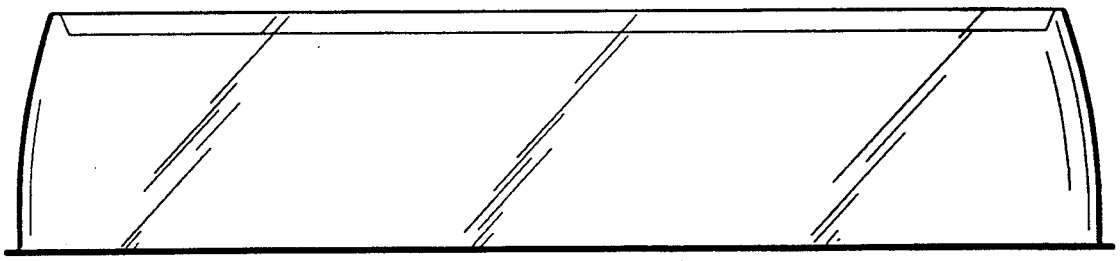
FIG. 7 is a side elevational view of a cover for the device of FIG. 8.
Figure 8:
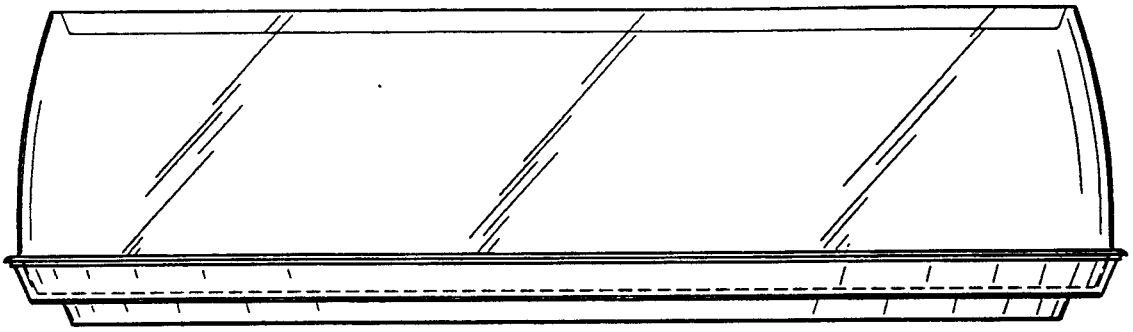
FIG. 8 is a side elevational view the base, food tray and cover of another embodiment of the present invention.
Figure 9:
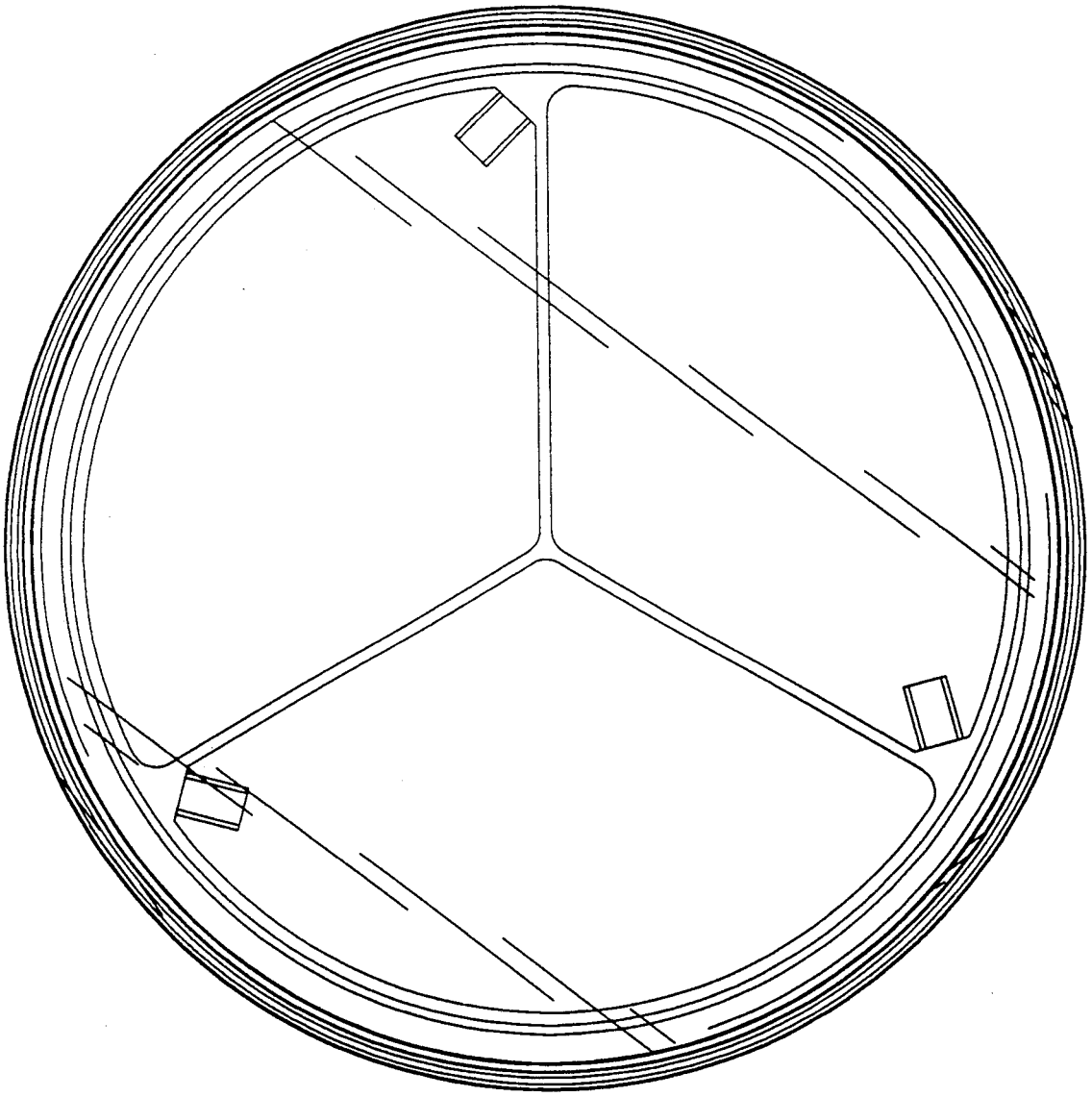
FIG. 9 is a top plan view of the base, refrigerant units, and food tray of the embodiment of FIG. 8.

An alternative food service device having a generally circular definition is illustrated in FIGS. 7–9. In this embodiment, the base 12 does not require a refrigerant positioning portion 22 since each of the refrigerant units 36 are configured to interfit with each other in puzzle-like relationship to position the units 36 within the refrigerant cavity 20 in a stable manner. The food tray is then nested with the base 12 as discussed above. The cover, shown in FIG. 9, includes a recess section 62 to receive and support the refrigerant cavity 20 of a base tray 12.

While a preferred embodiment of the invention has been described with particularity, modifications or alterations may be made therein without departing from the spirit and scope of the invention set forth in the appended claims.

I claim:

1. A food service device for the refrigeration of food comprising:

a) a base having interior and exterior surfaces, said base inner surface defining a refrigerant cavity and a tray support section, said tray support section being adjacent and above said refrigerant cavity, said inner surface also having a refrigerant positioning portion centrally disposed within the refrigerant cavity and defining an aperture in the exterior base surface;

b) refrigerant means removably disposed within said refrigerant cavity about and in interlocking relationship with said refrigerant positioning portion;

c) a tray having a central recess portion and a perimetral portion surrounding said recess portion, said tray being configured to interfit with said base in nested relationship; and d) a lid configured to interfit with said tray when placed in stacked relationship, said lid including side walls and a roof, said roof defining a recess section disposed in spaced relationship with said side walls, said recess section including a handle, said handle being disposed axially above the refrigerant positioning portion of said base when the base, tray and lid are disposed in stacked relationship.

2. The device of claim 1 wherein the exterior surface of the base is configured to fit within said recess section of the lid of a second like device such that the handle of said lid interfits with the aperture defined by the refrigerant positioning portion when the base and lid of the second like device are placed in stacked nesting relationship.

3. The device of claim 1 wherein the refrigerant means includes at least one refrigerant unit containing a coolant media, said unit interfitting within said refrigerant cavity and about said refrigerant positioning portion in puzzle-like fashion.

4. The device of claim 1 wherein the exterior surface of the base nests within the recess section of the lid, said handle interfitting in an aligned relationship with the aperture defined by the refrigerant positioning portion of the base when placed in stacked relationship.

5. A refrigerant device comprising:

a) a base having a lower surface and integrally defining alignment means within said lower surface, side walls integrally secured to said lower surface, the side walls and lower surface defining a refrigerant cavity;

b) a tray support surface secured to the side walls, tray support walls, said walls being integrally secured to the tray support surface; and c) a tray support mantle secured to said tray support walls;

d) refrigerant means, said means being removably disposed within said refrigerant cavity, the alignment means positioning the refrigerant means within the cavity in interfitting relationship;

e) a food tray configured to interfit in spaced nesting relationship with said tray support surface, tray support walls and tray support mantle, said food tray including a cover support surface, sidewalls, a lip, and a bottom, the bottom being disposed in spaced relationship with the refrigerant cavity of the base when in nested relationship, said tray sidewalls, bottom and lip being perimetrally supported by the base tray support surface, tray support walls, and mantle when the tray is disposed in nesting relationship with said base;

f) a lid, said lid having side walls and a roof, the side walls supporting the roof in spaced relationship to the tray when the lid is disposed in supporting relationship with said cover support surface; and g) said roof including a support cavity and a second alignment portion, whereby the roof and second alignment portion supportably receive a refrigerant cavity of a second like device when placed in stacked relationship.

6. The refrigerant device of claim 5 wherein the lid side walls and the roof support cavity define a condensation channel on an interior surface of the lid whereby condensation is channeled from said support cavity to said lid side wall portions.

7. A cold storage device for food comprising:

a) a base having a recess portion and a positioning portion, said positioning portion being centrally disposed within said recess portion and defining an aperture on the exterior surface of the base;

b) an upper tray configured to fit within the base in nesting relationship and in spaced relationship with a bottom surface of the recess portion and said positioning portion, the base and said tray interacting in support relationship when said tray and said base are nested;

c) refrigerant media for disposition within said recess portion in interfitting relationship, said media having a spaced relationship to said upper tray when said base and said upper tray are disposed in nesting relationship;

d) a cover portion configured to interfit with said upper tray, said cover including a roof portion having a base recess, said recess configured to surround and support an exterior surface of a base tray of a second like cold storage device when placed in stacked relationship.

8. The cold storage tray of claim 7 wherein the refrigerant media is removable, said media being disposed within the recess portion base in interfitting puzzle-like relationship with the positioning portion.

9. The cold storage device of claim 7 wherein the cover and base further comprise alignment means for aligning and interlocking the base and the cover of a second like device when placed in stacked relationship.

10. The cold storage device of claim 9 wherein the base recess further defines a handle integral to said cover portion.

11. A portable food service device for food comprising:

a) a base, said base having a refrigerant cavity with internal and external surfaces and a tray support portion;

b) refrigerant means including a plurality of similarly sized and shaped refrigerant units, said refrigerant units being removably disposable within the refrigerant cavity in an interfitting puzzle-like relationship;

c) a food support tray, said tray being removably supported in interfitting relationship by the tray support portion, said tray being supported in spaced relationship to said refrigerant units disposed within said cavity;

d) the tray including a cover support shelf integrally, perimetrally defined; and e) a lid, said lid being sized to interfit with the cover support shelf, said lid includes a cover recess, said cover recess configured to accept and surroundingly support the external surface of the refrigerant cavity of the base, when said base and said lid are placed in stacked relationship.

12. A food service device for maintaining food in a refrigerated condition prior to serving comprising:

a) a configured, solid recyclable refrigerant of the type maintaining a solid external surface and a substantially constant configuration when cycled from a cold condition to a warm condition while absorbing heat from food being refrigerated and thereafter is chilled to return it to its cold condition;

b) a base component including walls defining a refrigerant receiving cavity having a configuration complemental to the refrigerant for removably receiving and retaining the refrigerant in substantially constant spacial relationship when the device is in use;

c) a food support tray component including at least one food support surface;

d) the components having complemental tray component support surfaces for supporting the tray component on the base component and above the refrigerant when the device is in use;

e) a cover having surfaces complemental with surfaces on one of the components for support of the cover about said at least one support surface and further including a knob projecting from a base in a recess in said cover;

f) said tray component and cover together defining a food storage cavity with the tray component being adapted to support food on said at least one support surface with the food normally in spaced relationship with the cover; and g) the base component having a refrigerant locator projecting into a complemental aperture in the refrigerant when the device is in use, said locator being externally hollow and configured to complementally receive a knob on a cover of a like food service device when two of said food service devices are stacked.

13. The food service device of claim 12 wherein said cover and base have complemental surfaces whereby a base component of one food service device may be supported by the cover of another food service device.

14. The food service device of claim 12 wherein said cover has side walls and inwardly spaced cavity walls defining the perimeter of said recess, said recess being centrally disposed in said cover, the cavity walls and side walls together defining an internal space circumferential of the recess and above the recess base when the device is in use whereby the internal space will function as a condensation space and condensation will collect on the side walls thereby to inhibit condensation on the recess base and dripping on the food.

15. A food service device for maintaining food in a refrigerated condition prior to serving comprising:

a) a configured, solid recyclable refrigerant of the type maintaining a solid external surface and a substantially constant configuration as it is cycled from a cold condition to a warm condition while absorbing heat from food being refrigerated and thereafter is chilled to return it to its cold condition;

b) said refrigerant being comprised of a plurality of complementally positionable parts which, when complementally positioned, collectively define a central circular aperture;

c) a unitary molded base including cavity walls defining the perimeter of a refrigerant cavity adapted complementally to receive the refrigerant when its parts are complementally positioned;

d) a tray including at least one food support surface;

e) the base including an upwardly projecting refrigerant locator disposed centrally of the refrigerant cavity and being complementally disposed in the refrigerant aperture when the device is in use;

f) the tray and base leaving complemental surfaces for supporting the tray perimetrally of the refrigerant cavity with the tray above and in spaced relationship with the refrigerant when the device is in use;

g) a molded unitary cover, the cover and tray having complemental support surfaces to support the cover on the tray with the tray and cover together defining a food storage volume;

h) the cover and base component having complemental surfaces whereby the base component may be supported on the cover and whereby like devices can be stacked;

i) the cover having side walls and inwardly spaced cavity walls defining the perimeter of a centrally disposed recess, the cavity walls and side walls together defining an internal space circumferential of the recess and above a recess base when the device is in use whereby the internal space will function as a condensation space and condensation will collect on the side walls thereby to inhibit condensation on the recess base and dripping on the food;

j) the cover including a knob projecting upwardly from the recess base; and k) the refrigerant locator being externally hollow and configured to complementally receive the knob of a like device when two such devices are stacked.

* * * * *